US007819632B2

(12) United States Patent
Hoell et al.

(10) Patent No.: US 7,819,632 B2
(45) Date of Patent: Oct. 26, 2010

(54) TURBO MACHINE WITH A ROTOR WHICH HAS AT LEAST ONE ROTOR DISK WITH A BORE

(75) Inventors: Harald Hoell, Wächtersbach (DE); Reimar Schaal, Darmstadt (DE); Werner Setz, Rösrath (DE)

(73) Assignee: Siemens Aktiengesellschaft, Munich (DE)

( * ) Notice: Subject to any disclaimer, the term of this patent is extended or adjusted under 35 U.S.C. 154(b) by 773 days.

(21) Appl. No.: 11/631,768

(22) PCT Filed: Jun. 10, 2005

(86) PCT No.: PCT/EP2005/052698

§ 371 (c)(1),
(2), (4) Date: Jul. 12, 2007

(87) PCT Pub. No.: WO2006/003074

PCT Pub. Date: Jan. 12, 2006

(65) Prior Publication Data

US 2008/0031724 A1 Feb. 7, 2008

(30) Foreign Application Priority Data

Jul. 5, 2004 (EP) ..... 04015806

(51) Int. Cl.
*F01D 5/06* (2006.01)

(52) U.S. Cl. ..... 416/244 A; 29/889

(58) Field of Classification Search ..... 415/208.1; 416/201 R, 198 A, 244 A; 29/888.024, 889, 29/889.2, 889.3

See application file for complete search history.

(56) References Cited

U.S. PATENT DOCUMENTS

| | | | | |
|---|---|---|---|---|
| 2,579,745 | A | 12/1951 | Lombard et al. | |
| 4,497,612 | A | 2/1985 | Knorowski et al. | |
| 4,844,694 | A | 7/1989 | Naudet | |
| 5,586,860 | A * | 12/1996 | Bertrand et al. | 415/115 |
| 5,860,789 | A * | 1/1999 | Sekihara et al. | 416/201 R |
| 7,241,111 | B2 * | 7/2007 | Harding et al. | 415/218.1 |

FOREIGN PATENT DOCUMENTS

| | | |
|---|---|---|
| EP | 1 013 893 B1 | 3/2006 |
| GB | 219 655 | 5/1925 |
| JP | 62 251403 A | 11/1987 |

* cited by examiner

*Primary Examiner*—Igor Kershteyn

(57) ABSTRACT

The invention relates to a rotor disk for the rotor of a non-positive displacement machine with at least one borehole extending in an axial direction. The aim of the invention is to provide a rotor disk for a non-positive displacement machine that has an increased serviceable life. To this end, the boring extends in an at least partially convex manner whereby having an enlarged diameter in the middle area in order to increase internal compressive stress an to reduce tangential stresses.

11 Claims, 4 Drawing Sheets

TURBO MACHINE WITH A ROTOR WHICH HAS AT LEAST ONE ROTOR DISK WITH A BORE

CROSS REFERENCE TO RELATED APPLICATIONS

This application is the US National Stage of International Application No. PCT/EP2005/052698, filed Jun. 10, 2005 and claims the benefit thereof. The International Application claims the benefits of European Patent application No. 04015806.5 filed Jul. 5, 2004. All of the applications are incorporated by reference herein in their entirety.

FIELD OF INVENTION

The invention relates to a turbo machine having a rotor which is mounted such that it can rotate about an axis of rotation and has at least one rotor disk in which is arranged at least one axially extending bore. The invention also relates to a rotor for a turbo machine and to a rotor disk having at least one bore extending axially through the rotor disk.

BACKGROUND OF THE INVENTION

Stationary gas turbines and aircraft turbines having rotors composed of a plurality of rotor disks are generally known. One central tie rod or a plurality of eccentric tie rods clamp the rotor disks together. For this purpose, the rotor disks have at least one cylindrical bore through which the tie rods extend.

Rotor disks of this type are known, for example, from U.S. Pat. No. 2,579,745. Each rotor disk is I-shaped in cross section and bears the rotor blades of the turbine or compressor on its outer flange, which is arranged parallel to the axis of rotation. The radially inner flange likewise extends parallel to the axis of rotation, radially inwardly directed projections being provided at the outer ends, as seen in the axial direction, of the inner flange. As a result, the inner flange of the rotor disk has a recess located between the projections, and the circumferential surface, facing the axis of rotation of the rotor, of this recess has a cylindrical profile in the central region between the two outer projections.

Moreover, GB 219 655 has disclosed a rotor disk with a central bore, at which a sprung arm which projects freely on one side is provided on the hub side, as seen in the axial direction. To improve the spring action of the arm, the latter is tapered in the central region of its axial extent.

Furthermore, JP 62-251403 A has disclosed a single-piece rotor for a twin-flow steam turbine, this rotor having a central bore. To reduce the density of material stresses in the tangential direction, the central rotor bore has a recess which is annular in cross section, runs around the inner circumference and lies approximately parallel to the reference stress lines.

On its outer circumference, each rotor disk bears rotor blades which are arranged in a ring and around which a flow medium can flow in order for said flow medium to be compressed or for rotational energy to be absorbed from a flow medium. In operation, the rotor blades secured to the rotor disk produce huge centrifugal forces, and consequently each rotor disk is exposed to high levels of load.

The rotor disks must be entirely free of defects if they are to be able to withstand these loads. To ensure that this is the case, it is known to use suitable test methods which can be used to examine the rotor disk for cracks and defects prior to initial use and also during repeat tests, in order to ensure a minimum service life and therefore safe operation of the turbo machine.

The ability to detect cracks during the tests is increasingly restricted by the increasing size of rotor disks with a bore or if coarse-grain materials are used.

One way of ensuring the required service life is the deliberate introduction of compressive residual stresses into the material of the rotor disks, which delay the growth of defects, i.e. cracks, during subsequent operation. For this purpose, while the rotor disk with a bore is being produced, it is deliberately overloaded, i.e. it is spun at a rotational speed which is higher than the nominal rotational speed of the rotor. This causes plastic deformation in the region of the bore, leading to compressive residual stresses. However, the level of the compressive residual stresses in the disk material is limited by the maximum spinning speed of the spinning test bench and by the temperature during spinning, and consequently fewer compressive residual stresses can be produced than would ultimately be desirable.

The defects in the rotor disk which have not been detected and/or cannot be tolerated may continue to produce and enlarge cracks, on account of the high levels of load and the limited level of compressive residual stresses, and these cracks reduce the service life of the rotor disk and therefore of the turbo machine.

SUMMARY OF INVENTION

Therefore, the object of the invention is to provide a rotor disk for the rotor of a turbo machine, a rotor for a turbo machine and a turbo machine whose service life is lengthened by design measures.

The object relating to the turbo machine, the rotor and the rotor disk are achieved by the features of the claims. Advantageous configurations are given in the subclaims.

According to the invention, it is provided that, in the axial direction, has a portion which is convexly curved, i.e. has a larger diameter in this portion. The additional recess formed in the bore as a result of the convex geometry consequently does not include a cylindrical portion.

The solution is based on the inventive idea that the at least partially convexly curved profile of the bore as seen in the axial direction increases the Mises reference stresses in the region of the bore and evens out the tangential stresses. The increase in the reference stress is based on the axial and tangential stress components being influenced by the convexly curved geometry of the bore, i.e. its convex sectional shape. The higher reference stresses, during spinning, lead to greater plastic deformation in the hub region, with the result that the level of the compressive residual stresses increases for geometric reasons, without it being necessary to increase the spinning speed. Higher compressive residual stresses mean that crack propagation is delayed and there is a reduced risk of brittle fracture during subsequent operation.

The inventive step compared to JP 62-25143 therefore lies in particular in the disclosed that the transverse contraction in a rotor disk is significantly lower than in the case of the known, single-piece rotor shaft. Compared to the known rotor shaft, with the rotor disk according to the invention it is for the first time possible, on account of the significantly lower transverse contraction, to greatly increase the reference stress, which allows higher compressive residual stresses to be introduced. An increase in the reference stresses achieved in this way was not hitherto known.

Furthermore, the tangential stresses decrease as a result of the convex curvature of the bore in the axial direction. Because these tangential stresses likewise promote crack formation and crack growth when the turbo machine is operating, the convexly curved profile counteracts and significantly delays crack growth.

The turbo machine may expediently be designed as a turbine, as a compressor, as a gas turbine or as a steam turbine. In this context, it is of no relevance whether it is of single-stage or multi-stage design and of axial-flow or radial-flow design.

In an advantageous configuration, the bore is arranged centrally, i.e. at the center point of the rotor disk, and/or eccentrically, i.e. at a distance from the center point of the rotor disk. The effects achieved by the convexly curved embodiment are independent of whether the bore is provided centrally or eccentrically.

In an advantageous configuration, the maximum internal diameter of the convexly curved bore, as seen in the axial direction, is arranged centrally between the end, sides of the rotor disk, resulting in a symmetrical distribution of the increased compressive residual stress.

BRIEF DESCRIPTION OF THE DRAWINGS

The invention is explained with reference to a drawing, in which.

DETAILED DESCRIPTION OF INVENTION

Figure 1:
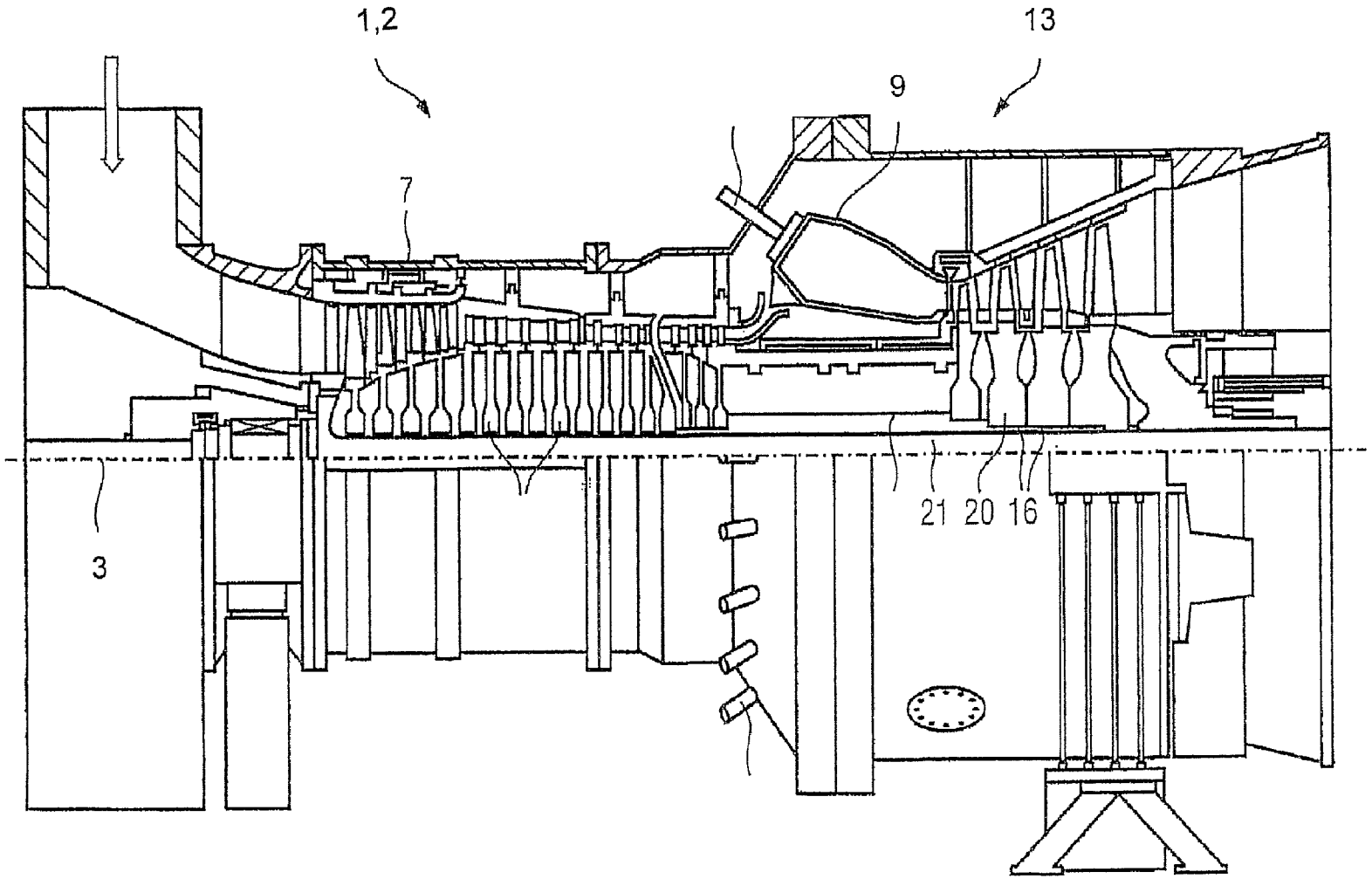
FIG 1 (Prior Art)
FIG. 1 diagrammatically depicts a turbo machine from the prior art.

Gas turbines and their modes of operation are generally known. In this respect, FIG. 1 shows a turbo machine which is designed as a gas turbine 1 and has a rotor 5 which is mounted such that it can rotate about an axis of rotation 3. In the longitudinal extent of the rotor 5, a compressor 7 is followed by a combustion chamber 9 with burners 11. The turbine unit 13 is connected downstream of the combustion chamber 9. Both in the compressor 7 and in the turbine unit 13, the rotor 5 has a plurality of rotor disks 20 which bear against one another and in each of which there is a central bore 16, through which a tie rod 21 extends.

Figure 2:
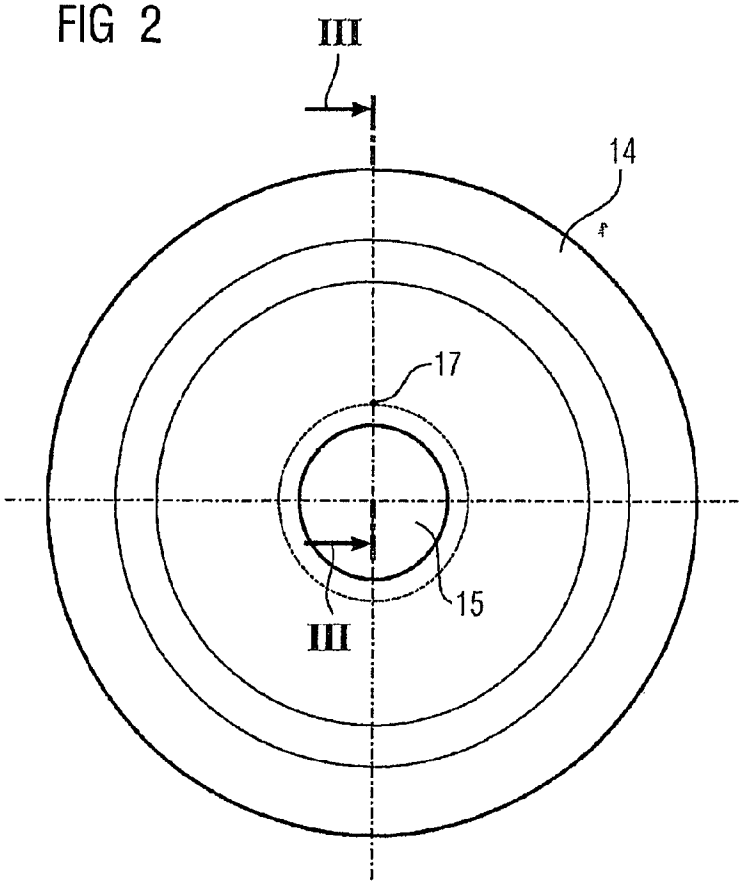
FIG. 2 shows a side view of a rotor disk according to the invention having a convexly curved bore.

FIG. 2 shows the side view of a rotor disk 14 according to the invention, with a centrally arranged bore 15 which is partially convex in the axial direction, i.e. curves outwards in this direction.

Figure 3:
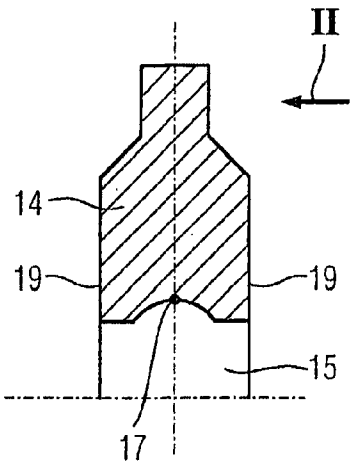
FIG. 3 shows a sectional view through the rotor disk from FIG. 2.

FIG. 3 shows a section through the rotor disk 14 according to the invention as shown in FIG. 2. The bore 15 is initially cylindrical in the axial direction of the rotor 5, then merges into a convexly curved portion before ending with another cylindrical portion. The diameter 17 of the bore 15 is at its greatest in the convexly curved portion in the center between the two end faces 19 of the rotor disk 14 and decreases uniformly on both sides in the direction of the end faces 19 or the cylindrical portions. As a result of the partially convexly curved profile of the bore 15 as seen in the axial direction, the rotor disk 14 has a recess which is convex, as seen in section, but not cylindrical at any point. The material of the rotor disk surrounding the recess therefore has a concave contour, as seen in section.

Figure 4:
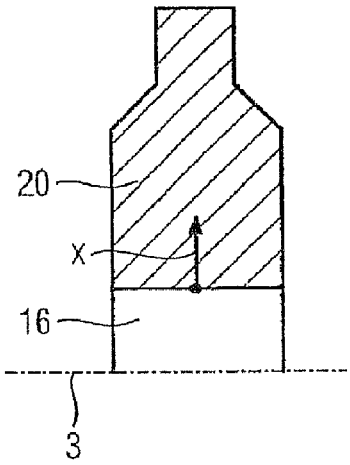
FIG 4 (Prior Art)
FIG. 4 shows a sectional view through a rotor disk from the prior art.

FIG. 4 shows a cylindrical bore 16 which is known from the prior art and passes through a rotor disk 20.

Figure 5:
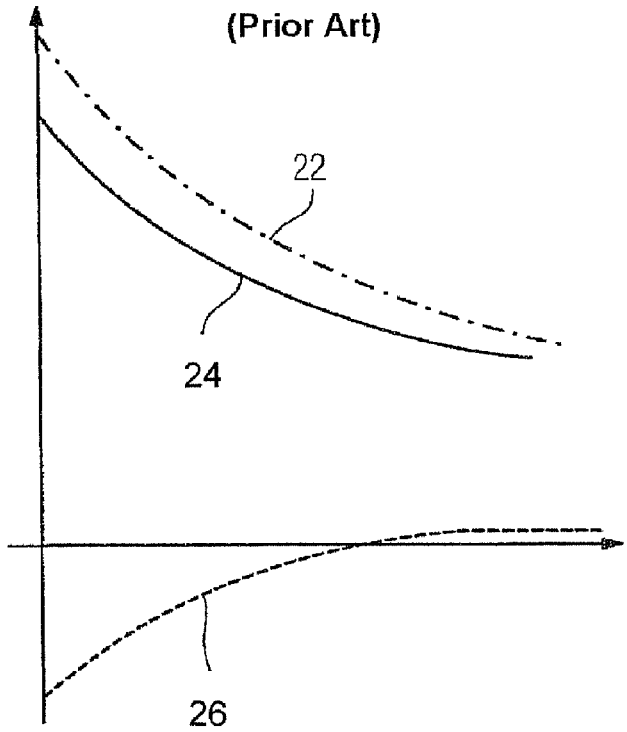
FIG 5 (Prior Art)
FIG. 5 shows a radius-stress diagram for the rotor disk from the prior art.

FIG. 5 shows the profile of stresses $\sigma$ in a rotor disk 20 from the prior art in a radius-stress diagram. The characteristic curve 22 illustrated as a dot-dashed line shows the profile of the tangential stresses at a distance x from the surface of the bore 16 in the radial direction. The characteristic curve 24 which is illustrated as a solid line shows the Mises reference stresses. Both stresses decrease at increasing distance x from the surface of the cylindrical bore 16 of the rotor disk 20. After the spinning of the rotor disk 20, the latter has compressive residual stresses, the profile of which is illustrated by characteristic curve 26, illustrated as a dashed line. The level of the compressive residual stresses decreases as the distance x increases.

Figure 6:
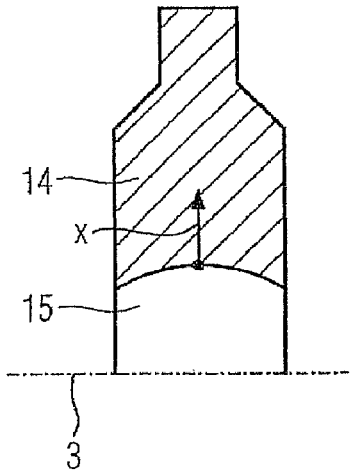
FIG. 6 shows a sectional view through the rotor disk according to the invention.

FIG. 6 shows the rotor disk 14 according to the invention with a bore 15 which is completely convex in the axial direction.

Figure 7:
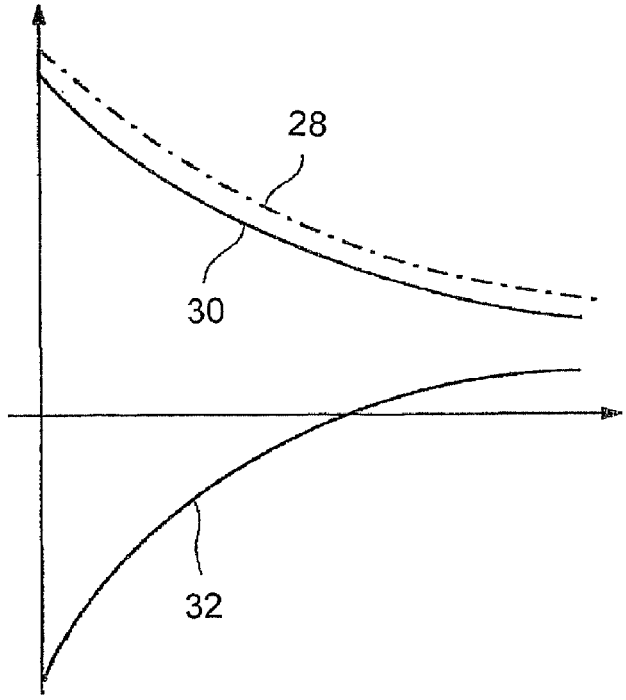
FIG. 7 shows a radius-stress diagram for the rotor disk according to the invention.

FIG. 7 shows the profile of stresses 6 of a rotor disk 14 according to the invention in a radius-stress diagram. The tangential stresses 28 of the rotor disk 14 according to the invention are illustrated by a dot-dashed line, and the Mises reference stresses 30 are illustrated as a solid line. Both forms of stress decrease at increasing distance x from the surface of the convex bore 15 of the rotor disk 14. After spinning of the rotor disk 14, the latter has a compressive residual stress 32 which is illustrated as a solid line and the level of which decreases as the distance x increases.

Figure 8:
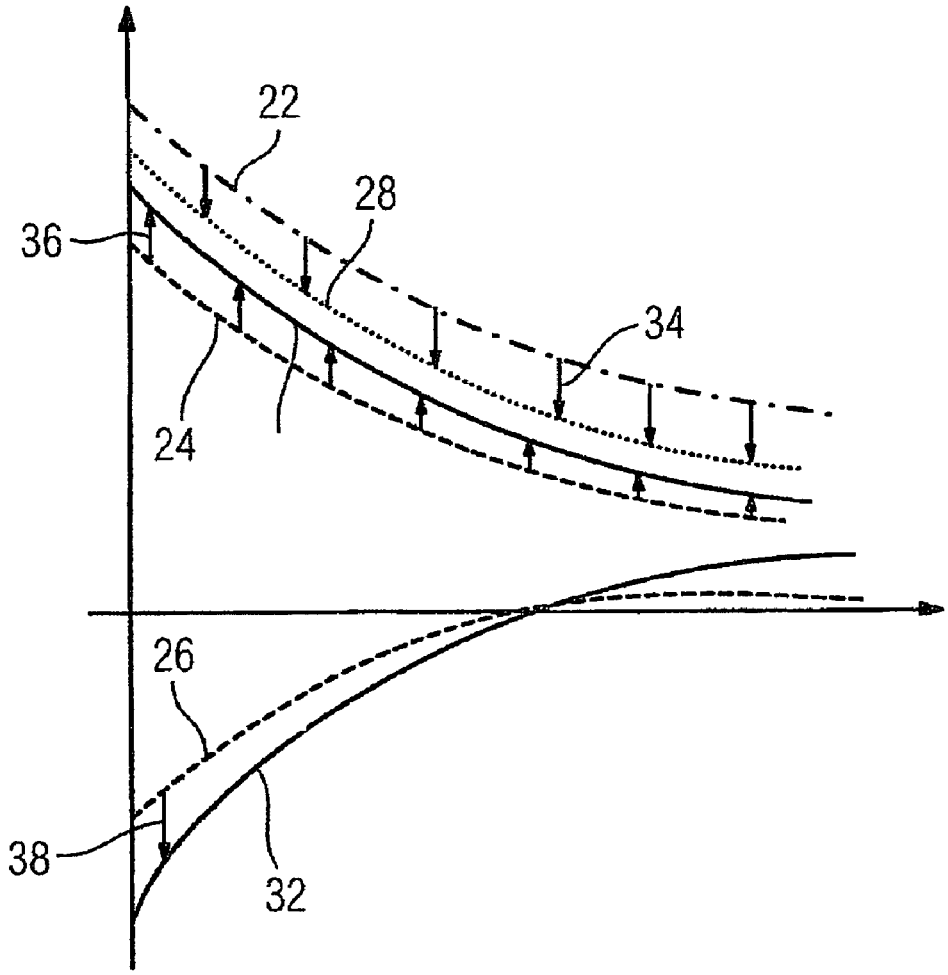
FIG. 8 shows a comparison of the characteristic curves from the diagrams illustrated in FIG. 5 and FIG. 7.

FIG. 8 shows the characteristic curves 22, 24, 26, 28, 30, 32 of the two diagrams FIG. 5 and FIG. 7 in comparison form.

The bore 14 which is convex, as seen in section, has reduced the tangential stresses 22 determined from the prior art to the tangential stresses 28, as indicated by the arrows 34. The Mises reference stresses 24, 30, by contrast, have been increased by the convex profile of the bore 15, as indicated by the arrows 36, which, after spinning at the same rotational speed, at least in the radially inner region of the convex bore 15, brings about an increased compressive residual stress, as indicated by the arrow 38.

The region located around each bore, in particular in the case of central bores, the region close to the hub, when the turbo machine is operating is exposed to in relative terms the highest levels of stress, with the result that the increase in the compressive stresses and reduction in the tangential stresses delays crack growth at this location and therefore lengthens the service life of the rotor disk, the rotor and the turbo machine.

The invention claimed is:

1. A method for producing a rotor disk, comprising:

forming the rotor disk;

forming a recess through the rotor disk in the axial direction of the rotor disk, the recess including a circular convexly contoured portion in the radial direction of the rotor disk; and spinning the rotor disk to achieve plastic, malleable deformations surrounding the recess after the forming, wherein the recess is effective to even the tangential stresses over a length of the recess and to increase the Mises reference stresses.

2. The method according to claim 1, wherein
the spinning is at a nominal rotational speed of a rotor of a turbo machine.

3. The method according the claim 1, wherein
the spinning is at a rotational speed greater than nominal rotational speed a of a rotor of a turbo machine.

4. The method according to claim 1, wherein
wherein a diameter of the recess is greatest in the convexly contoured portion.

5. The method according to claim 4, wherein
the greatest diameter is in the center of the convexly contoured portion, and
the diameter decreases uniformly on both sides of the center of the contoured portion.

6. The method according to claim 5, wherein
the recess comprises:
a first cylindrical portion and a second cylindrical portion, and
the convexly contoured portion abuts the first cylindrical portion on one side and the second cylindrical portion on the opposite side.

7. The method according to claim 1, wherein
the recess comprises:
a first cylindrical portion and a second cylindrical portion, and
the convexly contoured portion abuts the first cylindrical portion on one side and the second cylindrical portion on the opposite side.

8. The method according to claim 1, wherein
the convexly contoured portion forms the length of the recess.

9. The method according to claim 6, wherein
the convexly contoured portion forms the length of the recess.

10. The method according to claim 1, wherein
the recess is formed centrally at the center point of the rotor disk.

11. The method according to claim 1, wherein
the recess is formed eccentrically at distance from the center point of the rotor disk.

* * * * *